United States Patent [19]

Neumann et al.

[11] 4,227,765

[45] Oct. 14, 1980

[54] COAXIAL ELECTRICAL CONNECTOR

[75] Inventors: George J. Neumann, Bedford; Barry Altschul, Framingham, both of Mass.

[73] Assignee: Raytheon Company, Lexington, Mass.

[21] Appl. No.: 11,618

[22] Filed: Feb. 12, 1979

[51] Int. Cl.[3] ..... H01R 13/34

[52] U.S. Cl. ..... 339/143 R; 339/177 E

[58] Field of Search ..... 339/177 R, 177 E, 7, 339/143 R, 126 R, 126 J, 136 R, 136 C, 64 RM; 285/226; 174/35 R, 35 C, 35 GC

[56] References Cited

U.S. PATENT DOCUMENTS

| | | | |
|---|---|---|---|
| 2,332,126 | 10/1943 | Allen | 174/35 R |
| 2,449,570 | 9/1948 | Violette | 174/35 C |
| 3,091,748 | 5/1963 | Takes et al. | 339/64 R X |
| 4,030,797 | 6/1977 | Nieman | 339/64 M |

FOREIGN PATENT DOCUMENTS

| | | | |
|---|---|---|---|
| 1540373 | 1/1970 | Fed. Rep. of Germany | 339/177 R |

*Primary Examiner*—Howard N. Goldberg
*Assistant Examiner*—Eugene F. Desmond
*Attorney, Agent, or Firm*—Richard M. Sharkansky; Joseph D. Pannone

[57] ABSTRACT

An electrical connector including a socket having an axis, a metal bellows connecting the socket to a support for adjustment of the axis in response to insertion within the socket of an axially misaligned plug or connector, the metal bellows further being an electromagnetic radiation shield between the plug or connector and the support.

14 Claims, 6 Drawing Figures

COAXIAL ELECTRICAL CONNECTOR

BACKGROUND OF THE INVENTION

This invention relates in general to electrical connectors and has particular reference to electrical connectors of quick connect or disconnect type comprising mated male-female plug and socket components insertable one within the other.

Mounting coaxial connectors so that they can be mated is conventional practice in the electronic field. However, it is often a problem to mate the connectors when they are not coaxially aligned or when mating must be performed blind. For example, one connector may be fixed to or project from a mounting such as a chassis over which is to be located a terminal board, cover, or the like on which is mounted the other connector. Obviously the board or cover interferes with the vision when an attempt is made to position the board or cover on the chassis in a manner whereby the connectors may be simultaneously connected.

A further problem is to construct such coaxial connectors in a manner which will prevent escape through the connection of electromagnetic radiation.

Misaligned coaxial connectors have been connected by the provision of an inwardly inclined conical end surface on the female connector or socket which functions to guide the male plug into the socket. However, while this serves to align the axes of the two components when one mounting means is laterally movable, it normally does not function properly to align the axes when the mounting means are not laterally movable. Furthermore, in such connectors there is usually no means provided for electromagnetic radiation shielding.

SUMMARY OF THE INVENTION

The present invention overcomes the above and other disadvantages of the prior art by the provision of a coaxial connector wherein the male and female components are individually mounted for relative motion toward and away from each other for ready mating and disconnection even though the mounting means for the components are not laterally adjustable.

The female or socket component comprises a connector which extends axially within a metal bellows, one end of the bellows being fixed mounted to a support over an opening therein, and the other end of the metal bellows being secured to a forward point or area of the socket. The bellows thus permits the axis of the socket to be adjusted universally laterally and angularly to an extent permitted by the confines of the opening in the mounting means.

The forward end of the socket has an inwardly inclined conical surface which functions to guide a misaligned mating plug into the socket, as is well known. However, while usually the plug is mounted for lateral movement so that its axis may be aligned with the axis of the socket when the connection is being made, in accordance with the present invention the metal bellows permits lateral or angular movement of the socket so that its axis may be aligned with the axis of the plug. Additionally, the metal bellows functions to prohibit undesired escape of electromagnetic radiation through the assembled connector.

A further feature of the invention is the provision of means for limiting the extent of outward axial travel of the outer end of the socket while permitting free inward axial movement as well as lateral and angular movement of the socket.

BRIEF DESCRIPTION OF THE DRAWINGS

The above and other objectives of this invention will become apparent from the following description taken in connection with the accompanying drawings, wherein.

DESCRIPTION OF THE PREFERRED EMBODIMENTS

Figure 1:
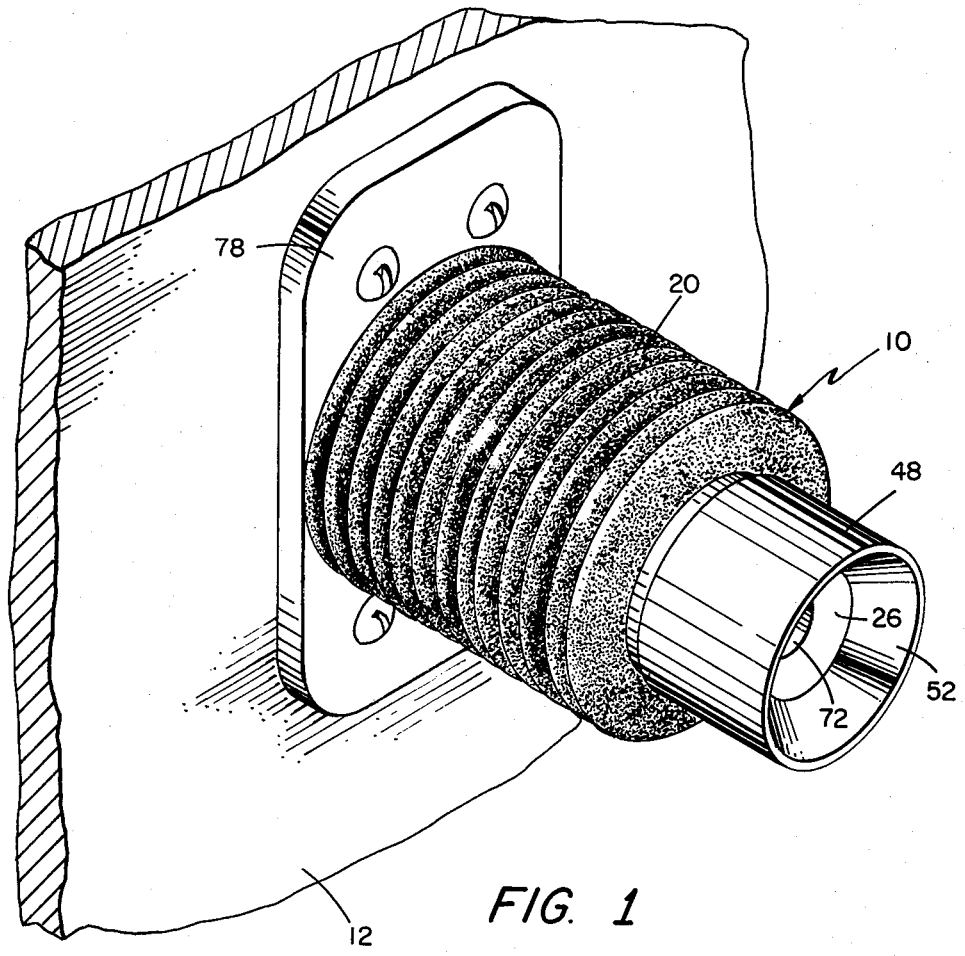
FIG. 1 is an isometric view of a coaxial connector embodying the invention.
Figure 2:
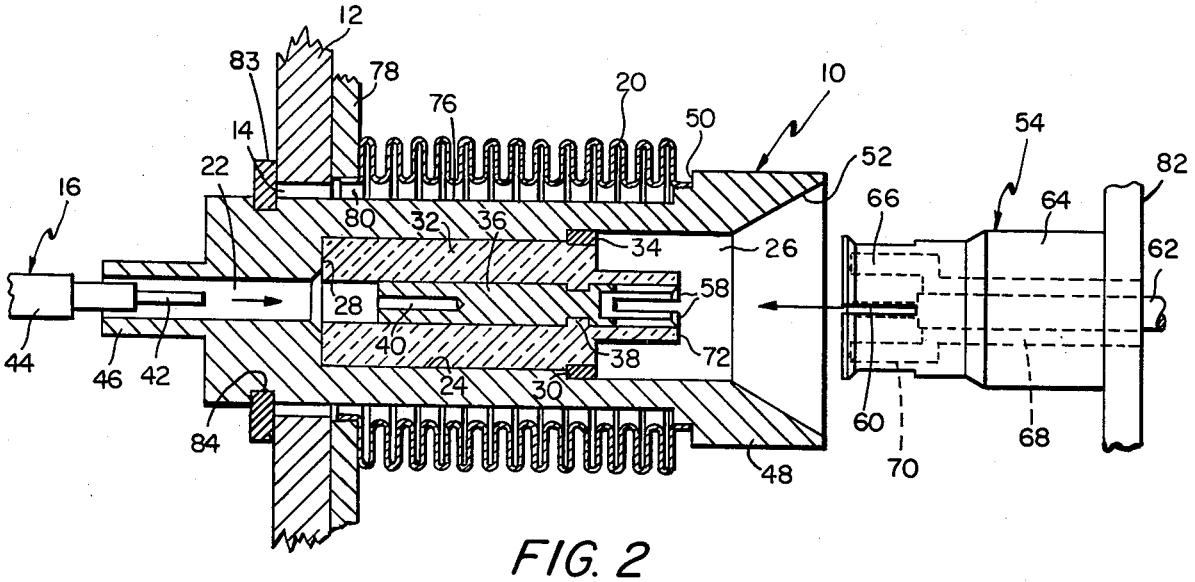
FIG. 2 is an axial sectional view through the connector shown in FIG. 1.

Referring more particularly to the drawings wherein like characters of reference designate like parts throughout the several views, a connector female or socket component 10 embodying a preferred form of the invention is shown in FIG. 1 mounted on a suitable fixed support 12. The support 12 may be any selected item such as a panel for a chassis, a terminal board, printed circuit board, or other fixed member to which the connector component 10 is secured. As shown in FIG. 2, the support 12 is provided with an opening 14 over which the component 10 is mounted so that a suitable cable 16 may be connected into the rear or inner end of the component 10 from the rear of the support 12.

The socket component 10, as shown best in FIG. 2, includes a generally cylindrical metal body 18, preferably nickel-plated brass, and an encircling spaced metal bellows 20. The body 18 has a longitudinal central bore comprised of a first small diameter portion or cavity 22 at the rear or inner end of the body, a second or intermediate portion 24, and a third forward or outer portion or cavity 26. The diameter of the intermediate portion 24 is larger than the diameter of the inner cavity 22 whereby there is formed a shoulder 28 at the junction thereof. Likewise, the diameter of the intermediate cavity 24 is smaller than the diameter of the outer cavity 26 so that a shoulder 30 is formed therebetween.

Within intermediate cavity 24 is disposed a generally cylindrical insulator member 32 which abuts at one end against shoulder 28 and is held in place near its other end by a metal washer 34 which is sealed to the inner wall of the body 18. Within the central bore of the insulator member 32 is a female metal contact member 36 of copper or other selected material which is retained in place by a raised flange 38 on the inner circumference of the insulator member 32, which flange interfits within a comating circumferential groove on the outer surface of the contact member 36.

The rear or inner end of the contact member 36 is foreshortened as shown in FIG. 2 and contains a short longitudinal central bore 40 which receives the inner conductor 42 of the coaxial cable 16. The inner end of the conductor 42 may be soldered in place in the bore 40 prior to installing contact member 36 into the central bore of the insulator member 32, and the outer cable conductor 44 may be soldered to the end portion 46 of the body 18 to fixedly secure the cable in place. The dimensions of the cavity 24, insulator 32 and member 36 are designed to match the R. F. impedance of the connector.

The outer or forward end of the socket component 10 comprises a somewhat enlarged socket or snorkel 48 which may be formed integrally on the end of the body 18 as shown or may be a separate member which is fixed to the end of the body 18 as by threads, welding, or mechanical means. The outer diameter of the socket 48 is somewhat larger than the diameter of the adjacent portion of the body, thus forming a shelf or shoulder 50 at their junction.

The socket 48 is provided with an inwardly inclined conical surface 52 which opens inwardly to communicate with the cavity 26. The inclined surface 52 is provided to guide a plug 54, receptacle or the like into the cavity for connection with the contact member 36. The adjacent end of the contact member 36 is shaped with opposed bifurcations 58 into which is forced a pinlike contact 60 on the end of a center conductor 62 carried in an insulated fashion within the coaxial plug 54.

The outer shell 64 of the plug 54 has a number of spring-like projections 66 formed on its end which is inserted within the cavity 26, the projections enabling the plug to slidingly resiliently engage the wall of the cavity 26. Encasing the conductor 62 in plug 54 is an insulator sleeve 68 which has an annular or tubular forward end portion 70 which is disposed in spaced encircling relation to the pin contact 60 and is adapted to slidingly engage the adjacent reduced diameter end portion 72 of the insulator sleeve 32 in the socket body 18.

The socket 10 is adjustably mounted on the support 12 by the metal bellows 20 which has its forward end soldered or otherwise suitably fixed to the shoulder 50 on snorkel 48. The metal bellows encircles the socket body 48 and is separated from it by a space 76 for reasons to be described. The rear end of the bellows 20 is soldered or otherwise fixed to a metal flange 78 which is bolted or otherwise attached to the support 12. The flange 78 is a platelike element having an aperture 80 which is substantially aligned with the opening 14 in the support 12.

From the foregoing it will be apparent that the only support for the socket 10 upon the support 12 is provided by the metal bellows 20. The socket is supported only near its forward end at shoulder 50, and the body 18 thereof extends freely rearwardly through the space 76 within the bellows and through the aligned openings 80 and 14 in the flange 78 and support 12. Thus, the socket body 18 is freely movable laterally, angularly, and axially inward by virtue of the flexibility of the bellows but within the confines of the openings 14 and 80 and space 76.

It will be apparent that the cable 16 may be permanently connected at one end to the socket as described and may be connected at its other end to any electrical circuit or component which is disposed at the side of the support 12 opposite to the side which mounts the bellows 20.

It will also be apparent from the foregoing that a plug 54 or any other mating component may be releasably connected with the socket 10, as described. The present invention, however, enables the plug 54 or other component to be relatively easily connected to the socket 10 even when it is mounted on the rear side of a panel 82, or board, cover or the like which would prevent an assembler from visually observing the mating process. Such "blind" assembling of a plug 54 with socket 10 is aided considerably by the fact that even if the axis A—A of the plug 54 is misaligned with respect to the axis B—B of the socket 10, mating can still be accomplished if the end of the plug 54 is moved into engagement with the inwardly inclined conical surface 52 of the snorkel 48 on the socket 10. Then continued pressure upon the plug 54 will cause its forward end to move down the inclined surface 52 and to enter the cavity 26 to eventually mate with the insulator end 72 and plug contact member 36.

Figure 3:
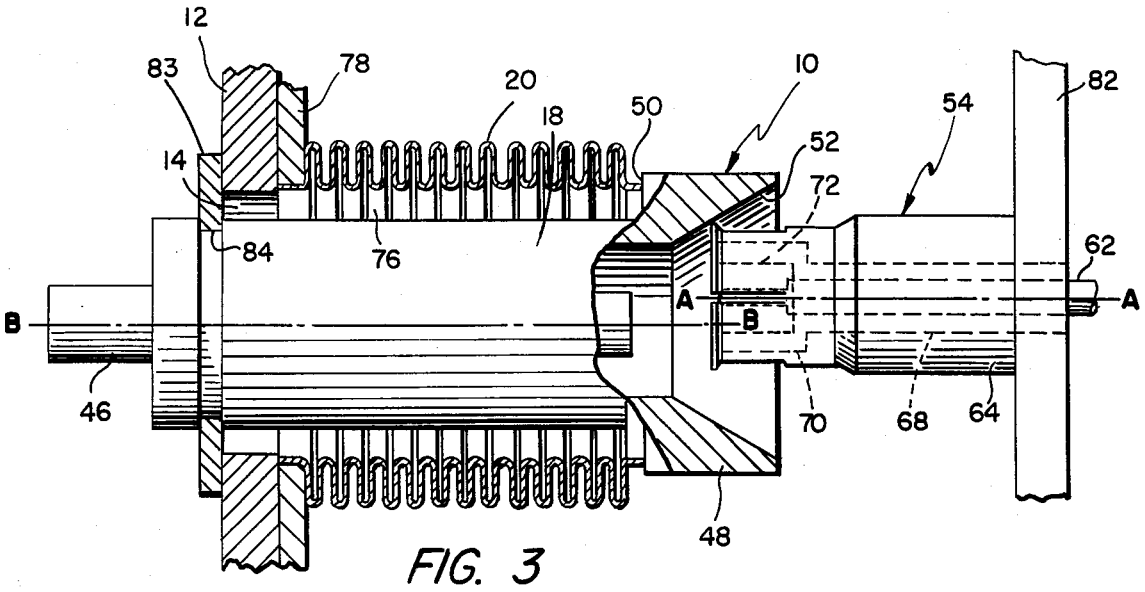
FIG. 3 is an elevational view illustrating the initial step in assembling a laterally misaligned plug with a connector embodying the invention.
Figure 4:
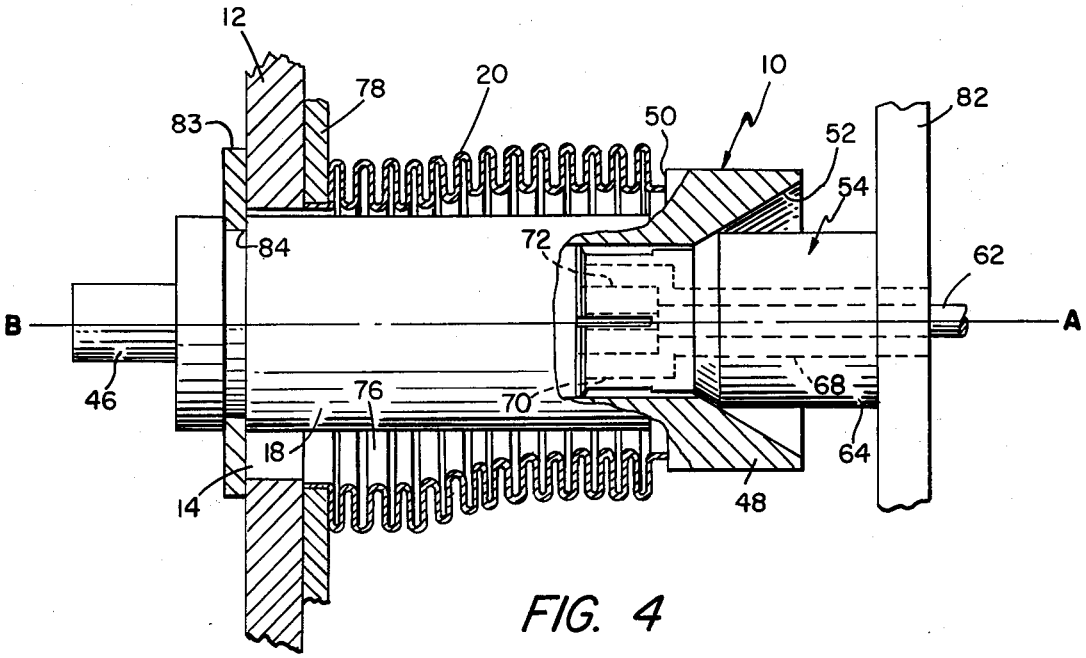
FIG. 4 is a view similar to FIG. 3 showing the components connected together.

Such initial engagement of a misaligned plug 54 with a socket 10 is shown in FIG. 3 where it will be noted that the end of the plug engages the sloping inner wall 52 of the snorkel 48. In FIG. 4 it can be seen that continued pressure of the plug 54 upon the socket 10, and particularly on the snorkel 48, causes the socket body 18 to move because of the flexibility of the bellows 20. Thus, the misaligned axes A—A and B—B become aligned as axis A–B.

Figure 5:
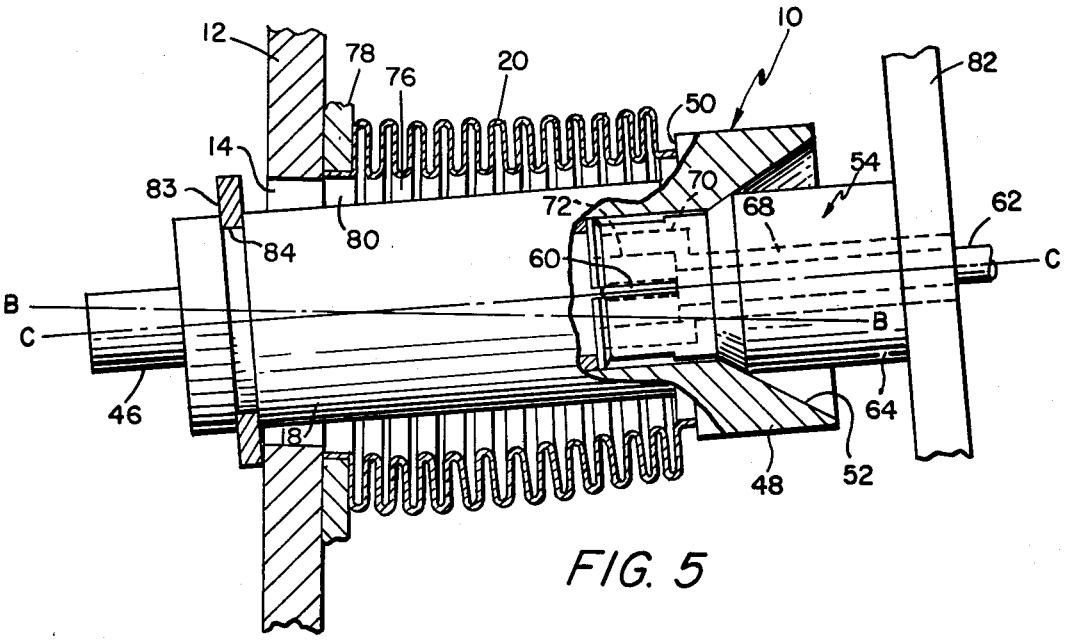
FIG. 5 is a view similar to FIG. 4 showing the connector assembly when the axes are angularly misaligned.

It is to be further understood that the axis B—B of the socket 10 may not only be displaced laterally as shown in FIG. 4 but, by virtue of the simple support provided by only the bellows 20, it may also be displaced angularly to accomodate an angularly misaligned axis C—C of a plug 54. Such angular displacement of the socket axis can be seen in FIG. 5. Thus, the single bellows connection between the socket 10 and support 12 achieves universal adjustment of the axis of the socket to the axis of a plug, regardless of misalignments thereof, without the need for additional gimbaling or other adjustable connections.

Furthermore, the described device provides complete shielding from escape of undesired electromagnetic radiation through the connector, the metal bellows providing such shielding.

In further accordance with this invention there is provided means for limiting the extent of outward movement of the socket body 18. Such means is provided by a removable ring or collar 83, preferably a snap ring, which closely encircles at least a major portion of the circumference of the rear or inner end portion of the body 18 and which fits within a groove 84 provided therein. The groove 84 is spaced at a predetermined distance from the outer end of the snorkel 48 so that the snorkel 48 will be located at a selected desired distance from the panel or support 12 when the ring 83 rests against the back side of the support 12. The ring 83 will not interfere in any way with inward movement of the body 18 and consequent compression of the bellows 20. It also will not interfere with lateral or angular movement of the body 18.

It has been found that if some slight amount of compression of the bellows 20 exists when the ring 83 normally abuts the rear surface of the panel 12, this will provide some degree of rigidity in the structure, thereby possibly preventing damage thereto.

From the foregoing it will be apparent that in accordance with this invention there has been provided a novel and efficient coaxial connector which allows mating of a rigidily mounted component with a mating component regardless of nominally misalignments therebetween and regardless of the problem of blind assembly, all in a manner which achieves minimal phase distortion. It is to be understood, of course, that although the adjustable component has been shown and described herein as the female or socket member, the male or plug member may comprise the adjustable component if desired.

Figure 6:
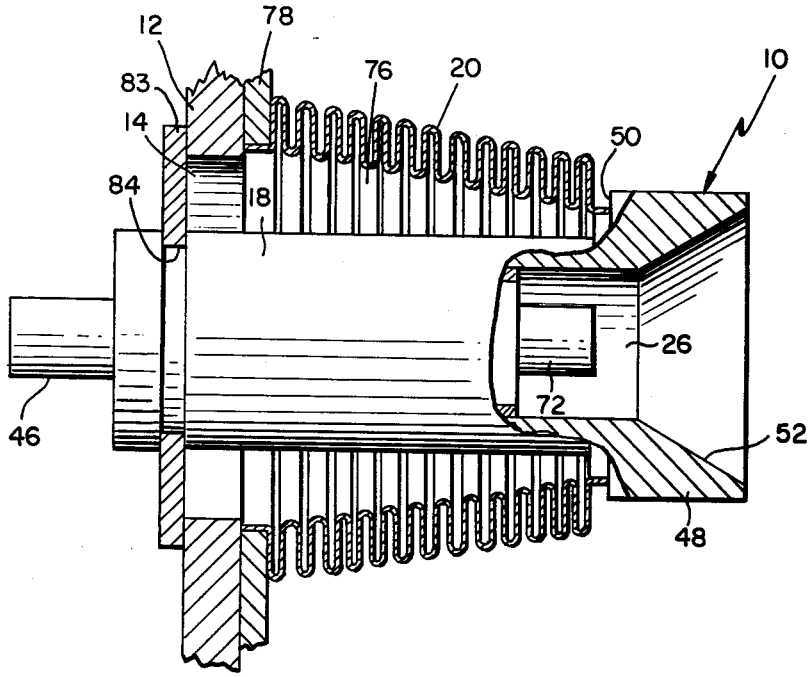
FIG. 6 is a side elevational view illustrating a modified metal bellows configuration.

It will also be apparent from the foregoing that various modifications and changes in the structures shown and described may be made, such as by providing the metal bellows with a conical configuration as shown in FIG. 6, and that such changes may be made by those skilled in the art without departing from the spirit of the invention as expressed in the accompanying claims. Therefore, all matter shown and described is to be interpreted as illustrative and not in a limiting sense.

What is claimed is:

1. A coaxial electrical connector comprising a substantially cylindrical body having spaced first and second end portions and an elongate central portion intermediate said end portions, said body having an axial bore therethrough, a tubular insulator fixed within said bore, a metal member within said insulator, said insulator and metal member extending coaxially within the bore and having ends shaped to interfit with electrical components to be mated therewith, a support member spaced from and encircling said first end portion of the body, a self-supporting, tubular, flexible, electrically conductive member spaced from and encircling said central portion of the body, said flexible member having one end fixed at, and electrically connected to, said support member and having its other end fixed and electrically connected to said second end portion of the body to support such body within the self-supporting tubular member, and means carried by said body for limiting travel of the body in a direction axially outward away from said support member.

2. A connector as set forth in claim 1 wherein said first end portion of the body is provided with a conical end wall inclined inwardly to communicate with said bore.

3. A connector as set forth in claim 1 wherein said flexible member is of a material nontransparent to electromagnetic radiation.

4. A connector as set forth in claim 1 wherein said flexible member is an electromagnetic radiation shield.

5. A connector as set forth in claim 1 wherein said first end portion of the body extends through an opening in said support member, said flexible member is connected to one side of the support member around the opening, and said means comprises a ring disposed on said first end portion of the body and disposed at the side of the support member opposite the flexible member.

6. A connector as set forth in claim 1 wherein said flexible member is a metal bellows.

7. A connector as set forth in claim 6 wherein said metal bellows is of substantially uniform diameter throughout its length.

8. A connector as set forth in claim 6 wherein said metal bellows is of substantially conical shape with its larger end affixed to said support member.

9. A connector as set forth in claim 1 wherein said second end portion of the body is secured throughout its circumference to the inner periphery of the adjacent end of the flexible member, and said body is otherwise freely suspended and movable within said flexible member and completely disassociated from said support.

10. A connector as set forth in claim 9 wherein the longitudinal axis of the body normally is disposed in a known plane, and wherein the body is adjustable to move said axis to a different plane or to an angle to said known plane.

11. A coaxial electrical connector comprising a substantially cylindrical electrically conductive body having spaced first and second end portions and an elongate central portion intermediate said end portions, said body having an axial bore therethrough, a tubular insulator fixed within said bore, a metal member within said insulator, said insulator and metal member extending coaxially within the bore and having ends shaped to interfit with electrical components to be mated therewith, a support member having an aperture spaced from and encircling said first end portion of the body for mounting the connector to a first side of a support, a self-supporting, tubular, flexible, electrically conductive member encircling said central portion of the body, said flexible member having a first end fixed to, and electrically connected to, said support member, said second end portion of the body being secured to, and electrically connected to, a second end of said flexible member to support such body within the self-supporting tubular member, whereby said body is freely suspended and movable within said flexible member and means carried by said body for engaging a second side of the support.

12. An electrical connector comprising:

an electrical conductor having spaced first and second portions and an intermediate elongate central portion;

said conductor having a longitudinal central bore therethrough, a tubular insulator and connector extending coaxially within the bore;

a flange member having an aperture;

said first portion of the conductor extending through said aperture;

a self-supporting, tubular, flexible, electrically conductive member encircling said conductor; and said flexible member being electrically and mechanically connected at one end thereof to said flange member and at the other end thereof being electrically and mechanically connected to said second portion of the conductor to support such conductor within the tubular member.

13. An electrical connector comprising:

an electrical conductor having spaced first and second portions and an intermediate elongate central portion;

said electrical conductor having a longitudinal central bore therethrough;

a tubular insulator with an axial connector extending coaxially within the bore;

a flange member having an aperture for mounting the connector to a first surface of a fixed support;

said first portin of the conductor extending through said aperture;

a self-supporting, tubular, flexible, electrically conductive member spaced from and encircling said central portion of the conductor;

said self-supporting member being mechanically and electrically connected at one end thereof to said flange member and being mechanically and electrically connected at the other end thereof to said second portion of the conductor to support such conductor with the self-supporting, tubular, flexible, electrically conductive member; and a retaining member disposed on said conductor and engageable with a second surface of the fixed support.

14. An electrical connector comprising:

an electrical conductor having spaced first and second end portions and an intermediate elongate central portion having a longitudinal central bore therethrough;

a tubular insulator with an axial connector extending coaxially within the bore;

a flange member having an aperture for mounting the connector to a first side of a fixed support having an aperture aligned with said flange member aperture;

said first end portion of the conductor extending through said flange member aperture;

a self-supporting, tubular, flexible, electrically conductive member spaced from and encircling said central portion of the conductor;

said flexible member being mechanically and electrically connected at one end thereof to said flange member and being mechanically and electrically connected at the other end thereof to said second end portion of the conductor to support such conductor within the tubular member; and a retaining member disposed on said conductor adjacent the first end portion and abutting the walls of said fixed support adjacent to said aperture at the side opposite to said first side of the fixed support to thereby exert a compressive force on said flexible member against said flange member and fixed support while said conductor is movable with respect to the fixed support.

* * * * *

UNITED STATES PATENT OFFICE

CERTIFICATE OF CORRECTION

Patent No. 4,227,765 Dated October 14, 1980

Inventor(s) George J. Neumann and Barry Altschul

It is certified that error appears in the above-identified patent and that said Letters Patent are hereby corrected as shown below:

In the Abstract of the Disclosure, after line 6, insert a new paragraph:

--The Government has rights in this invention pursuant to Contract Number F19628-76-C-0146 awarded by the Air Force.--

In the Claims, claim 13, column 6, line 57, change "portin" to --portion--.

Signed and Sealed this

*Twenty-first* Day of *April 1981*

[SEAL]

*Attest:*

RENE D. TEGTMEYER

*Attesting Officer*

*Acting Commissioner of Patents and Trademarks*